US009339166B2

(12) United States Patent
Thiyagarajan

(10) Patent No.: US 9,339,166 B2
(45) **Date of Patent: *May 17, 2016**

(54) DISHWASHER APPLIANCE AND A METHOD FOR OPERATING THE SAME

(71) Applicant: General Electric Company, Schenectady, NY (US)

(72) Inventor: Ramasamy Thiyagarajan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 27 days.

This patent is subject to a terminal disclaimer.

(21) Appl. No.: 14/203,783

(22) Filed: Mar. 11, 2014

(65) Prior Publication Data

US 2015/0257624 A1 Sep. 17, 2015

(51) Int. Cl.

| | |
|---|---|
| ***B08B 3/04*** | (2006.01) |
| ***A47L 15/42*** | (2006.01) |
| *A47L 15/00* | (2006.01) |

(52) U.S. Cl.

CPC ..... *A47L 15/4208* (2013.01); *A47L 15/4225* (2013.01); *A47L 15/0007* (2013.01); *A47L 2501/02* (2013.01); *A47L 2501/03* (2013.01); *A47L 2501/05* (2013.01); *A47L 2501/34* (2013.01)

(58) Field of Classification Search

CPC ..... A47L 15/4208; A47L 15/0007; A47L 15/4225

See application file for complete search history.

(56) References Cited

U.S. PATENT DOCUMENTS

| | | | | |
|---|---|---|---|---|
| 5,097,855 | A | 3/1992 | Martinsson et al. | |
| 6,832,617 | B2 | 12/2004 | Hegeman et al. | |
| 2004/0003830 | A1* | 1/2004 | Elick | A47L 15/4225 134/10 |
| 2011/0126855 | A1* | 6/2011 | Pyo | A47L 15/4208 134/10 |
| 2012/0055511 | A1* | 3/2012 | Kim | A47L 15/0031 134/10 |
| 2014/0158168 | A1* | 6/2014 | Thiyagarajan | A47L 15/4206 134/104.2 |
| 2015/0129511 | A1* | 5/2015 | Thiyagarajan | D06F 39/10 210/787 |
| 2015/0201824 | A1* | 7/2015 | Thiyagarajan | A47L 15/4208 134/10 |
| 2015/0257624 | A1* | 9/2015 | Thiyagarajan | A47L 15/4208 134/25.2 |

FOREIGN PATENT DOCUMENTS

| | | |
|---|---|---|
| EP | 0842632 | 5/1998 |

* cited by examiner

*Primary Examiner* — Bibi Carrillo
(74) *Attorney, Agent, or Firm* — Dority & Manning, P.A.

(57) ABSTRACT

A method for operating a dishwasher appliance is provided. The method includes operating a first pump and a second pump of the dishwasher appliance during a wash cycle of the dishwasher appliance, working the second pump of the dishwasher appliance during a soil collection cycle of the dishwasher appliance, and running the first pump of the dishwasher appliance during a drain cycle of the dishwasher appliance. The first pump of the dishwasher appliance is deactivated during the step of working, and the second pump of the dishwasher appliance is deactivated during the step of running. A related dishwasher appliance is also provided.

13 Claims, 7 Drawing Sheets

DISHWASHER APPLIANCE AND A METHOD FOR OPERATING THE SAME

FIELD OF THE INVENTION

The present subject matter relates generally to dishwasher appliances and methods for operating dishwasher appliances with steps for reducing or preventing clogging of filter assemblies within the dishwasher appliances.

BACKGROUND OF THE INVENTION

During wash and rinse cycles, dishwasher appliances generally circulate a fluid through a wash chamber over articles, such as pots, pans, silverware, etc. The fluid can be, e.g., various combinations of water and detergent during the wash cycle or water (which may include additives) during the rinse cycle. Typically, the fluid is circulated during a given cycle using a pump. Fluid is collected at or near the bottom of the wash chamber and pumped back into the wash chamber through, e.g., nozzles in spray arms and other openings that direct the fluid against the articles to be cleaned or rinsed.

Depending upon the level of soil on the articles, fluids used during wash and rinse cycles will become contaminated with soils in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump.

For mechanical filtration, the selectivity of the filter to remove soil particles of different sizes is typically determined by providing fluid paths (such as pores or apertures) through filter media that are smaller than the particles for which filtration is desired. Particles having a dimension larger than the width of the fluid paths will be trapped or prevented from passing through the filter media while particles smaller than the width of the fluid path will generally pass through. Certain particle sizes and/or types may be not harmful to the pump or spray assemblies and, therefore, can be allowed to pass into the pump inlet. However, while some smaller particles may not be harmful to the pump, leaving such particles in the wash or rinse fluid may not be acceptable as these particles may become deposited on the articles being washed/rinsed and thereby affect the user's perception of the cleanliness and/or appearance.

While larger particles can generally be readily removed from the fluid circulated through the wash chamber, challenges are presented in removing smaller particles—particularly as the particle size targeted for removal decreases. For example, if a dishwashing appliance is provided with a fine particle filter—such as one for removing particles 200 microns or larger—the filter can be prone to clogging particularly during the early stages of the cleaning process. During a pre-wash cycle or early stage of a wash cycle, a greater amount of larger food particles may be present on the articles placed in the wash chamber. A fine particle filter—such as one for removing particles 200 microns are larger—may become substantially clogged.

To unclog the filter, a conventional approach has been to drain the dirty fluid from the wash chamber to remove the particles clogging the filter. New—i.e. clean fluid—is then reintroduced for cycling again. Depending on the level of soil still present on the articles, yet another cycle of draining and refilling may have to be repeated. Unfortunately, this run, drain, and refill approach for unclogging a filter is inefficient as it requires the use of additional fluid (i.e. water). Of course, a filter media can be selected that only captures larger particles so that it clogs less, such as e.g., 0.030" or larger, but this comes at the expense of losing the ability to remove smaller particles from the fluid and an associated effect on the resulting cleanliness of the articles.

Another challenge with filtration of the wash fluid is servicing of the filter and, more particularly, the filter media. Sometimes, for example, food particles can become lodged in the filter requiring that the filter be removed and either manually cleaned or replaced. Certain conventional dishwashing appliances do not have a filter that is readily accessible to the user and/or otherwise readily cleanable or serviceable.

Accordingly, a dishwasher appliance having filtering system for the removal of particles from the wash fluid would be useful. More particularly, a method for operating a dishwasher appliance with steps for reducing or preventing clogging of a filtering system would be useful.

BRIEF DESCRIPTION OF THE INVENTION

The present subject matter provides a method for operating a dishwasher appliance. The method includes operating a first pump and a second pump of the dishwasher appliance during a wash cycle of the dishwasher appliance, working the second pump of the dishwasher appliance during a soil collection cycle of the dishwasher appliance, and running the first pump of the dishwasher appliance during a drain cycle of the dishwasher appliance. The first pump of the dishwasher appliance is deactivated during the step of working, and the second pump of the dishwasher appliance is deactivated during the step of running. A related dishwasher appliance is also provided. Additional aspects and advantages of the invention will be set forth in part in the following description, or may be apparent from the description, or may be learned through practice of the invention.

In a first exemplary embodiment, a method for operating a dishwasher appliance is provided. The method includes operating a first pump and a second pump of the dishwasher appliance during a wash cycle of the dishwasher appliance, working the second pump of the dishwasher appliance during a soil collection cycle of the dishwasher appliance, and running the first pump of the dishwasher appliance during a drain cycle of the dishwasher appliance. The first pump of the dishwasher appliance is deactivated during the step of working, and the second pump of the dishwasher appliance is deactivated during the step of running.

In a second exemplary embodiment, a dishwasher appliance is provided. The dishwasher appliance includes a tub that defines a wash chamber. A spray assembly is positioned within the wash chamber. A sump is positioned at a bottom portion of the tub. A filter assembly is disposed within the sump. The filter assembly assists with defining a filtered volume and an unfiltered volume within the sump. A spray conduit extends between the filtered volume of the sump and the spray assembly. A first pump is coupled to the circulation conduit and is configured for selectively urging wash fluid from the unfiltered volume of the sump through the circulation conduit. A second pump is coupled to the spray conduit and configured for selectively urging wash fluid from the filtered volume of the sump to the spray assembly through the spray conduit. A circulation conduit extends between the unfiltered volume of the sump and the tub. A controller is in operative communication with the first pump and the second pump. The controller is configured for initiating a wash cycle of the dishwasher appliance and operating both the first pump and the second pump during the wash cycle. The second pump supplies wash fluid from the filtered volume of the sump to the spray assembly during the step of operating, and the first pump supplies wash fluid from the unfiltered volume of the sump to the wash chamber of the tub during the step of operating. The controller is also configured for starting a soil collection cycle of the dishwasher appliance and working the second pump during the soil collection cycle. The second pump supplies wash fluid from the filtered volume of the sump to the spray assembly during the step of working, and the first pump is deactivated during the step of working. The controller is further configured for commencing a drain cycle of the dishwasher appliance and running the first pump during the drain cycle. The second pump is deactivated during the step of running.

In a third exemplary embodiment, a method for operating a dishwasher appliance is provided. The method includes initiating a wash cycle of the dishwasher appliance, operating a first pump and a second pump of the dishwasher appliance during the wash cycle of the dishwasher appliance, starting a soil collection cycle of the dishwasher appliance after the wash cycle of the dishwasher appliance, working the second pump of the dishwasher appliance during the soil collection cycle of the dishwasher appliance, commencing a drain cycle of the dishwasher appliance after the soil collection cycle of the dishwasher appliance, and running the first pump of the dishwasher appliance during the drain cycle of the dishwasher appliance. The first pump of the dishwasher appliance is deactivated during the step of working, and the second pump of the dishwasher appliance is deactivated during the step of running.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
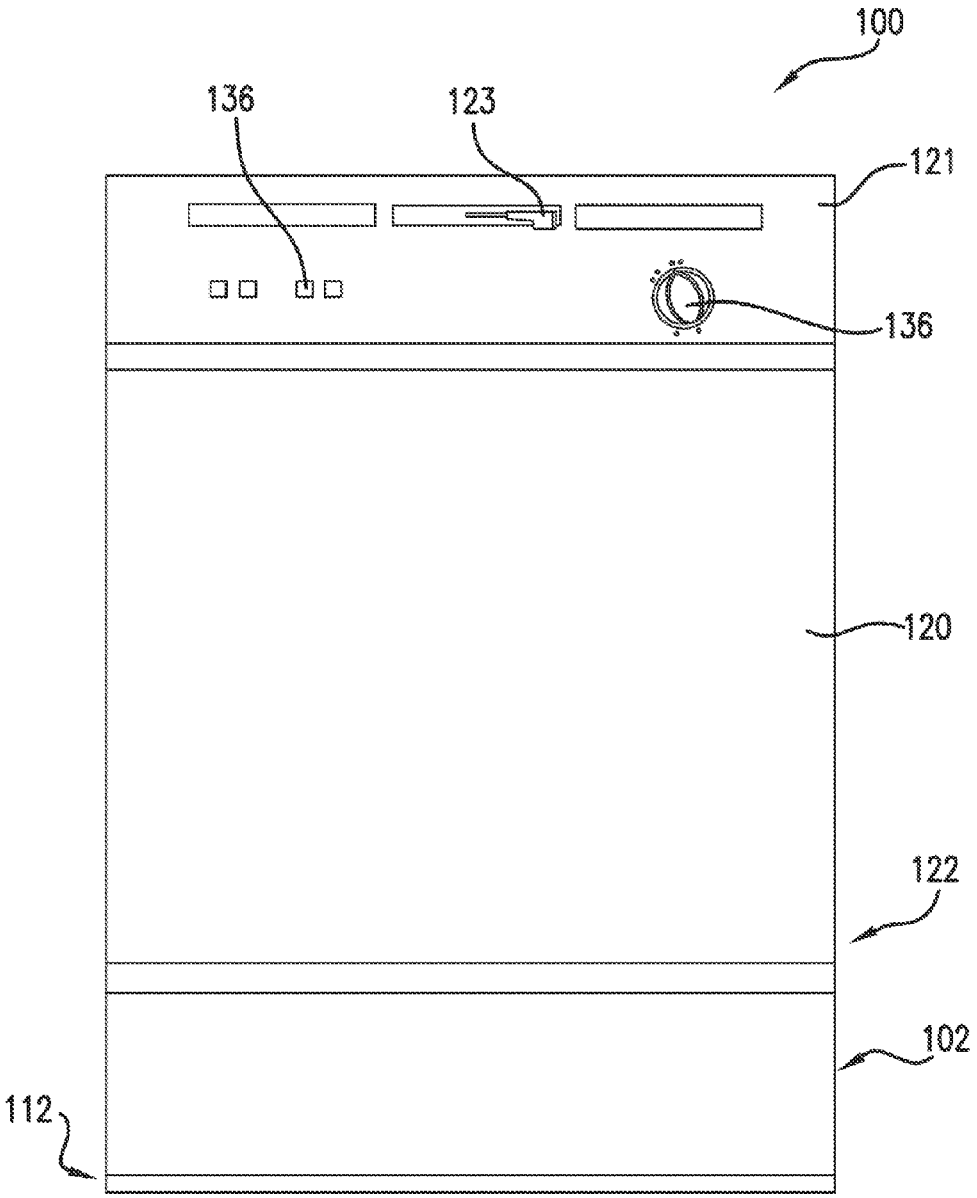
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
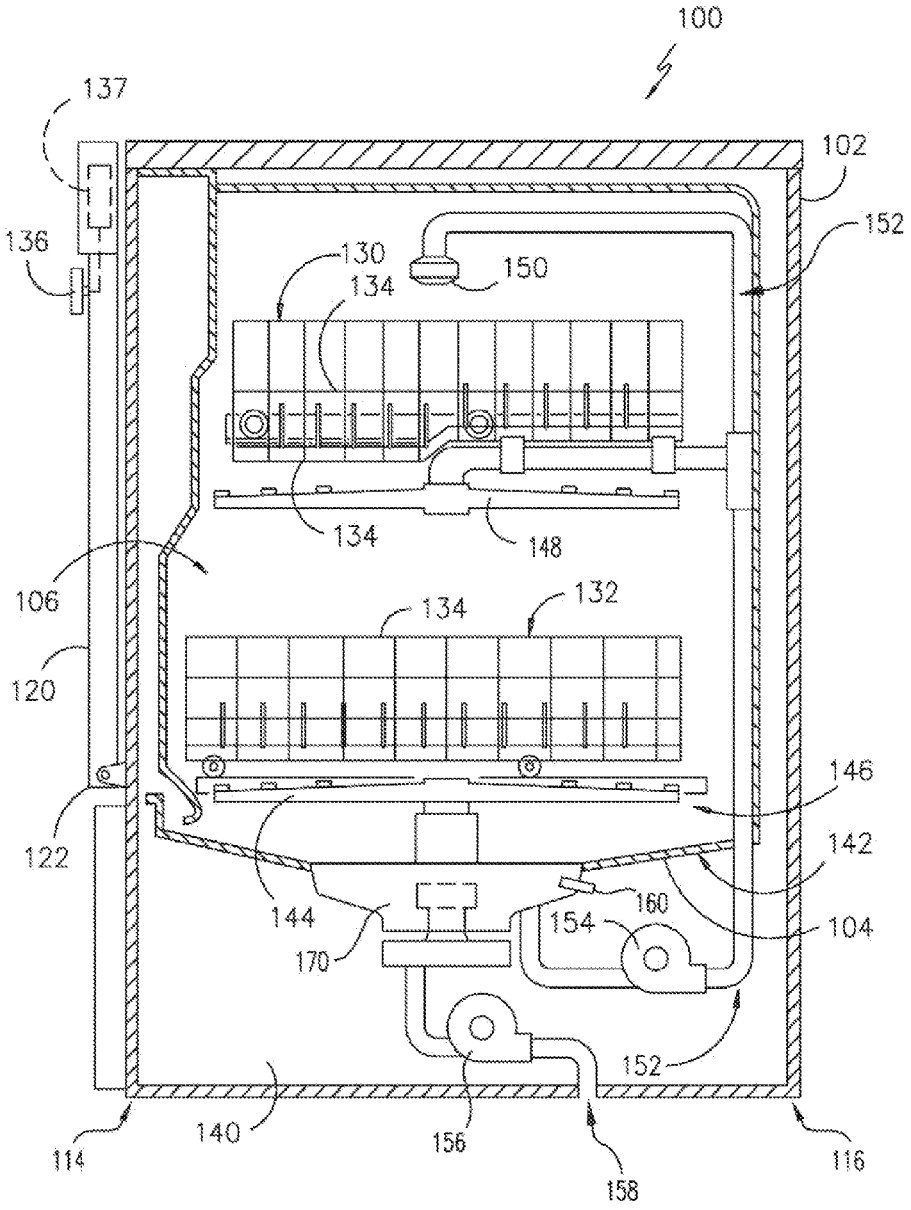
FIG. 2 provides a side, section view of the exemplary dishwasher appliance of FIG. 1.

FIGS. 1 and 2 depict a dishwasher appliance 100 according to an exemplary embodiment of the present subject matter. As shown in FIG. 1, dishwasher appliance 100 includes a cabinet 102. Cabinet 102 has a tub 104 therein that defines a wash compartment 106. The tub 104 also defines a front opening (not shown). Dishwasher appliance 100 includes a door 120 hinged at a bottom 122 of door 120 for movement between a normally closed, vertical position (shown in FIGS. 1 and 2), wherein wash compartment 106 is sealed shut for washing operation, and a horizontal, open position for loading and unloading of articles from dishwasher appliance 100. Latch 123 is used to lock and unlock door 120 for access to wash compartment 106. Tub 104 also includes a sump assembly 170 positioned adjacent a bottom portion 112 of tub 104 and configured for receipt of a liquid wash fluid (e.g., water, detergent, wash fluid, and/or any other suitable fluid) during operation of dishwasher appliance 100.

A spout 160 is positioned adjacent sump assembly 170 of dishwasher appliance 100. Spout 160 is configured for directing liquid into sump assembly 170. Spout 160 may receive liquid from, e.g., a water supply (not shown) or any other suitable source. In alternative embodiments, spout 160 may be positioned at any suitable location within dishwasher appliance 100, e.g, such that spout 160 directs liquid into tub 104. Spout 160 may include a valve (not shown) such that liquid may be selectively directed into tub 104. Thus, for example, during the cycles described below, spout 160 may selectively direct water and/or wash fluid into sump assembly 170 as required by the current cycle of dishwasher appliance 100.

Rack assemblies 130 and 132 are slidably mounted within wash compartment 106. Each of the rack assemblies 130 and 132 is fabricated into lattice structures including a plurality of elongated members 134. Each rack of the rack assemblies 130 and 132 is adapted for movement between an extended loading position (not shown) in which the rack is substantially positioned outside the wash compartment 106, and a retracted position (shown in FIGS. 1 and 2) in which the rack is located inside the wash compartment 106. A silverware basket (not shown) may be removably attached to rack assembly 132 for placement of silverware, utensils, and the like, that are otherwise too small to be accommodated by the racks 130 and 132.

Dishwasher appliance 100 further includes a lower spray assembly 144 that is rotatably mounted within a lower region 146 of the wash compartment 106 and above sump assembly 170 so as to rotate in relatively close proximity to rack assembly 132. A mid-level spray assembly 148 is located in an upper region of the wash compartment 106 and may be located in close proximity to upper rack 130. Additionally, an upper spray assembly 150 may be located above the upper rack 130.

The lower and mid-level spray assemblies 144 and 148 and the upper spray assembly 150 are fed by a fluid circulation assembly 152 for circulating water and dishwasher fluid in the tub 104. Fluid circulation assembly 152 may include a wash or recirculation pump 154 and a cross-flow/drain pump 156 located in a machinery compartment 140 located below sump assembly 170 of the tub 104, as generally recognized in the art. Cross-flow/drain pump 156 is configured for urging wash fluid within sump assembly 170 out of tub 104 and dishwasher appliance 100 to a drain 158. Recirculation assembly 154 is configured for supplying a flow of wash fluid from sump assembly 170 to spray assemblies 144, 148 and 150.

Each spray assembly 144 and 148 includes an arrangement of discharge ports or orifices for directing wash fluid onto dishes or other articles located in rack assemblies 130 and 132. The arrangement of the discharge ports in spray assemblies 144 and 148 provides a rotational force by virtue of wash fluid flowing through the discharge ports. The resultant rotation of the lower spray assembly 144 provides coverage of dishes and other dishwasher contents with a spray of wash fluid.

Dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated embodiment, controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, controller 137 includes a user interface panel 136 through which a user may select various operational features and modes and monitor progress of the dishwasher appliance 100. In one embodiment, user interface 136 may represent a general purpose I/O ("GPIO") device or functional block. In one embodiment, user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication with controller 137 via one or more signal lines or shared communication busses.

It should be appreciated that the subject matter disclosed herein is not limited to any particular style, model or configuration of dishwasher appliance, and that the embodiment depicted in FIGS. 1 and 2 is for illustrative purposes only. For example, instead of the racks 130 and 132 depicted in FIG. 1, dishwasher appliance 100 may be of a known configuration that utilizes drawers that pull out from the cabinet and are accessible from the top for loading and unloading of articles.

Figure 3:
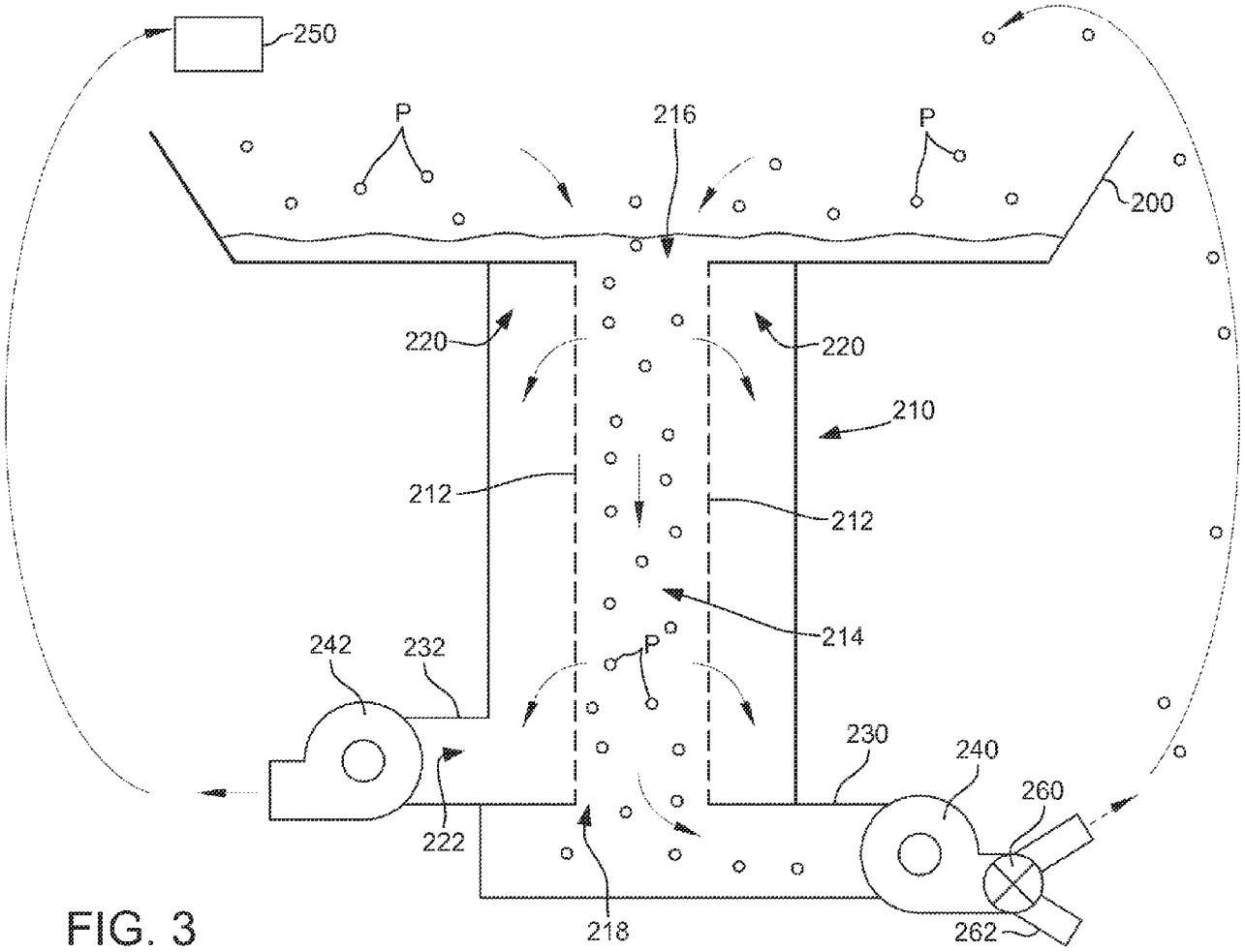
FIGS. 3, 4 and 5 provide schematic views of a sump and a filter assembly according to an exemplary embodiment of the present subject matter.
Figure 4:
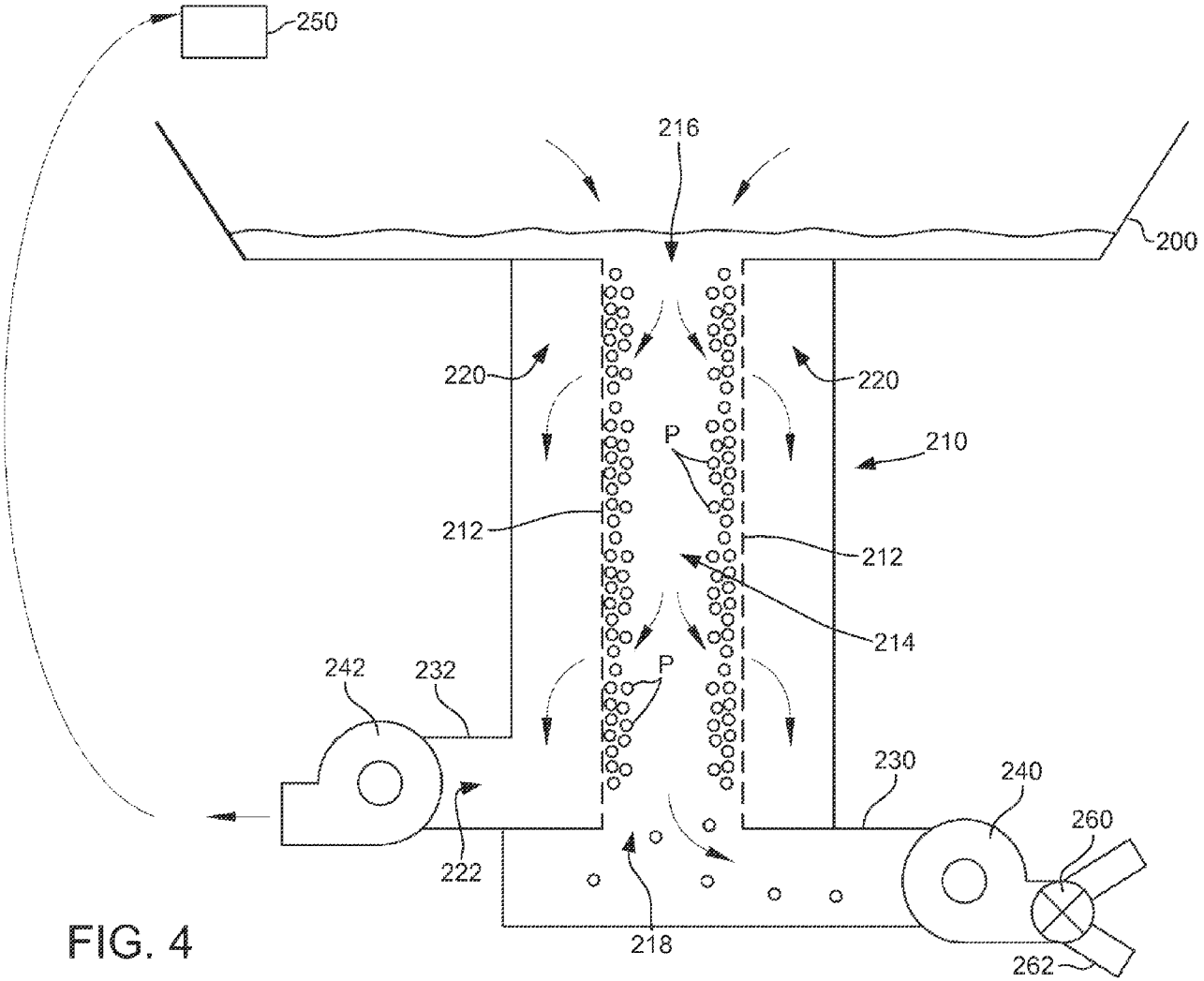
Figure 5:
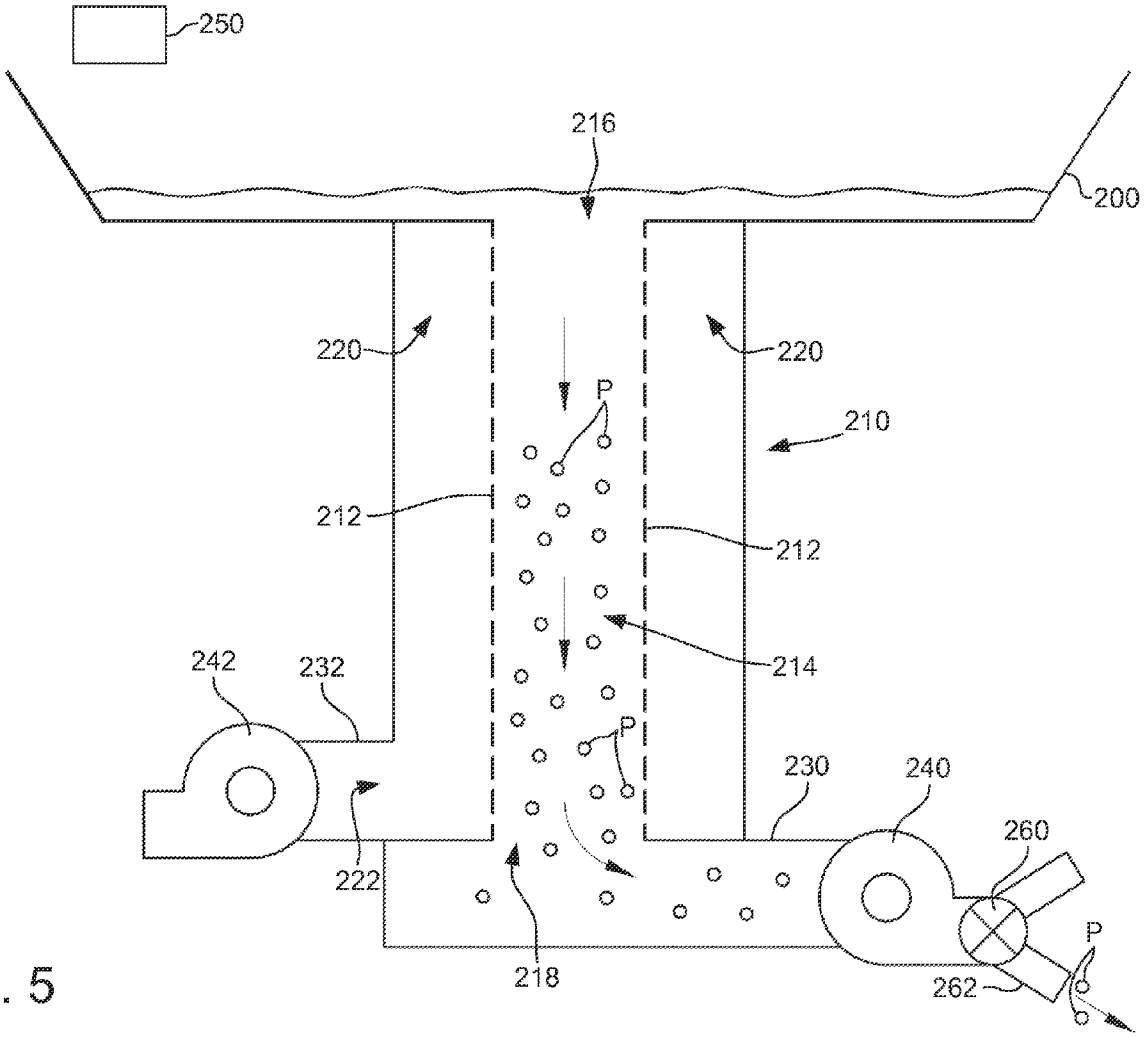

FIGS. 3, 4 and 5 provide schematic views of a sump 200 and a filter assembly 210 according to an exemplary embodiment of the present subject matter. Sump 200 and filter assembly 210 may be used in any suitable appliance. For example, sump 200 and filter assembly 210 may be used in dishwasher appliance 100 (FIG. 2), e.g., as sump assembly 170. In dishwasher appliance 100, filter assembly 210 filters liquid passing therethrough and supplies filtered liquid to at least one of spray assemblies 144, 148 and 150. Filtering liquid supplied to spray assemblies 144, 148 and 150 can assist with limiting or preventing clogging of spray assemblies 144, 148 and 150.

As may be seen in FIGS. 3, 4 and 5, filter assembly 210 includes filter media 212 and defines an unfiltered volume 214 and a filtered volume 220. Filter media 212 are disposed between filtered volume 220 and unfiltered volume 214. As used herein, the term "unfiltered" describes a volume that is not filtered relative to filter media 212 and the term "filtered" describes a volume that is filtered relative to filter media 212. However, as will be understood by those skilled in the art, filter assembly 210 may include additional filters that filter liquid entering unfiltered volume 214. Thus, unfiltered volume 214 may be filtered relative to other filters, such as a coarse filter, but not filter media 212. During operation filter assembly 210, filter media 212 may be fixed or static within filter assembly 210.

Unfiltered volume 214 has at least one entrance 216 and at least one exit 218. Entrance 216 of unfiltered volume 214 is in fluid communication with sump 200. Thus, unfiltered volume 214 is configured for receipt of liquid from sump 200, and liquid in sump 200 flows into unfiltered volume 214 via entrance 216 of unfiltered volume 214. As discussed in greater detail below, liquid in unfiltered volume 214 passes or flows through filter media 212 into filtered volume 220. Filter media 212 removes debris or particles P from liquid passing through filtering media 212 from unfiltered volume 214 to filtered volume 220. Thus, unfiltered liquid passes through filter media 212 to remove debris or particles P and exits filter media 212 into filtered volume 220 as filtered liquid. Filtered volume 220 also includes an exit 222. Filtered liquid within filtered volume 220 then exits filtered volume 220 via exit 222 of filtered volume 220. In such a manner, unfiltered liquid follows a path through filter assembly 210. In particular, unfiltered liquid passes through filter media 212, and filtered liquid exits filter assembly 210. Such filtering can assist with limiting or preventing clogs in associated spray assemblies of an appliance.

Liquid in unfiltered volume 214 can also pass or flow out of unfiltered volume 214 via exit 218 of unfiltered volume 214. Thus, rather than flowing through filter media 212 into filtered volume 220 as described above, liquid in unfiltered volume 214 also passes or flows out of unfiltered volume 214 via exit 218 of unfiltered volume 214. The bypassed liquid flows back into sump 200 without being filtered by or with filter media 212. Thus, filter assembly 210 generates a cross flow across filter media 212. Such cross flow can assist with limiting or preventing clogging or saturation of filter media 212 with debris or particles P.

Filter assembly 210 includes a first pump 240, a second pump 242, an exit conduit 230 and a recirculation conduit 232. Exit conduit 230 extends from exit 218 of unfiltered volume 214 to first pump 240. First pump 240 is operable to draw liquid from unfiltered volume 214 to or towards first pump 240 via exit conduit 230. First pump 240 may be any suitable pump. For example, when used in dishwasher appliance 100 (FIG. 1), first pump 240 may be cross-flow/drain pump 156. Exit conduit 230 may also extend from exit 218 of unfiltered volume 214 to sump 200. Thus, exit conduit 230 may be arranged or configured for directing liquid from unfiltered volume 214 to sump 200, e.g., during operation of first pump 240. When used in dishwasher appliance 100, exit conduit 230 may be arranged or configured for directing liquid from unfiltered volume 214 to wash compartment 106 of tub 104, e.g., during operation of cross-flow/drain pump 156. Thus, exit conduit 230 may extend from exit 218 of unfiltered volume 214 to tub 104.

In addition, a valve 260 is coupled to exit conduit 230. Valve 260 is operable to regulate a flow of liquid through exit conduit 230. In particular, valve 260 is selectively adjustable between a cross-flow or first configuration and a drain or second configuration. In the first configuration, valve 260 may permit liquid in exit conduit 230 to flow through valve 260 to sump 200, e.g., as described above. Conversely, valve 260 may direct liquid in exit conduit 230 to a drain 262 in the second configuration. Fluid in drain 262 may be directed out of dishwasher appliance 100, e.g., to an associated sewer or septic system. Thus, valve 260 may direct liquid flowing through exit conduit 230 to sump 200 or drain 262 depending upon the configuration or position of valve 260. Valve 260 may be any suitable valve. For example, valve 260 may be a solenoid valve in certain exemplary embodiments. Controller 137 may be in operative communication with valve 260 such that controller 137 may actuate valve 260 between the first and second configurations.

Recirculation conduit 232 extends from exit 222 of filtered volume 220 to second pump 242. Second pump 242 is operable to draw liquid from filtered volume 220 to or towards second pump 242 via recirculation conduit 232. Second pump 242 may be any suitable pump. For example, when used in dishwasher appliance 100 (FIG. 1), second pump 242 may be recirculation pump 154. Recirculation conduit 232 may also extend from exit 222 of filtered volume 220 to a spray assembly 250. Thus, recirculation conduit 232 may be arranged or configured for directing liquid from filtered volume 220 to the spray assembly 250, e.g., during operation of second pump 242. When used in dishwasher appliance 100, recirculation conduit 232 may be arranged or configured for directing liquid from filtered volume 220 to at least one of spray assemblies 144, 148 and 150, e.g., during operation of recirculation pump 154.

Filter media 212 may be configured for fine filtration—e.g. filtering of relatively small particles. Accordingly, in one exemplary aspect of the present subject matter, filter media 212 may be configured (e.g., define holes or apertures) for removing particles in the size range of about fifty microns to about four hundred microns. For example, filter media 212 may be a screen or mesh having holes in the size range of about fifty microns to about four hundred microns. In another exemplary aspect of the present subject matter, filter media 212 may be configured (e.g., define holes or apertures) for removing particles in the size range of about three hundred microns to about six hundred microns. For example, filter media 212 may be a screen or mesh having holes in the size range of about three hundred microns to about six hundred microns. These size ranges are provided by way of example only. Other ranges may be used in certain exemplary embodiments of the present subject matter as well.

Figure 6:
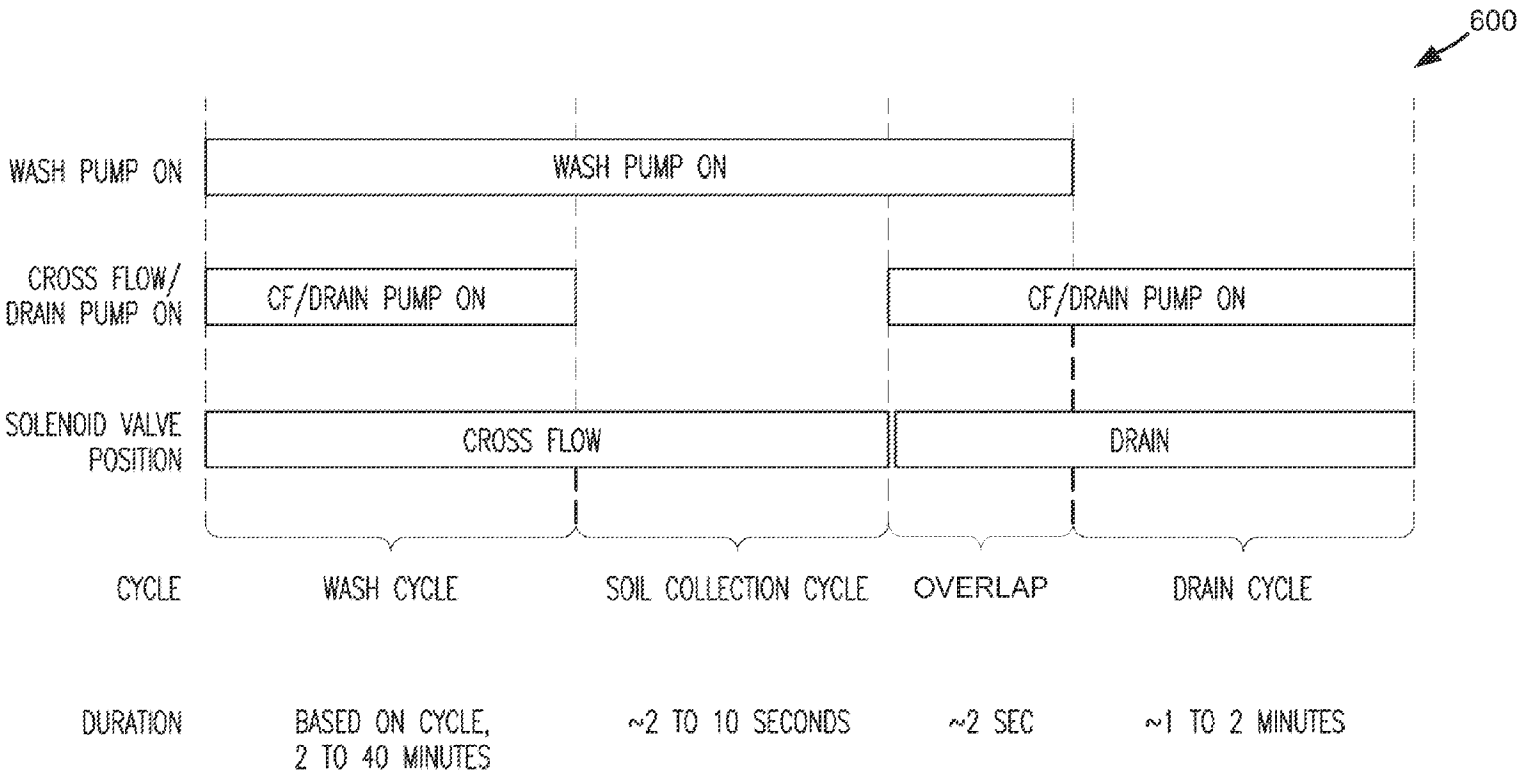
FIGS. 6 and 7 illustrate a method for operating a dishwasher appliance according to an exemplary embodiment of the present subject matter.
Figure 7:
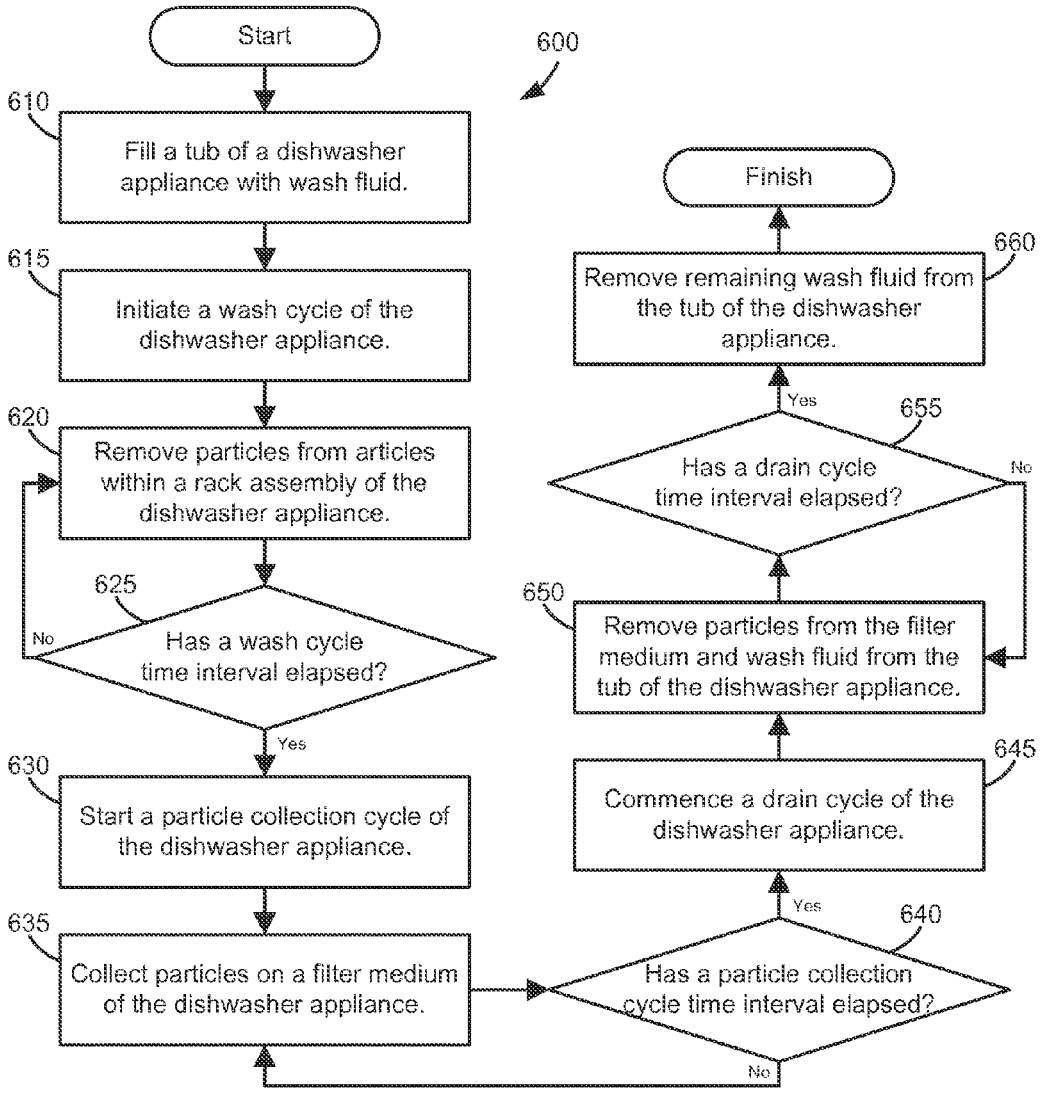

FIGS. 6 and 7 illustrate a method 600 for operating a dishwasher appliance according to an exemplary embodiment of the present subject matter. Method 600 may be used to operate any suitable dishwasher appliance. For example, method 600 may be used to operate dishwasher appliance 100 (FIG. 1). In particular, controller 137 may be configured or programmed to implement method 600. Utilizing method 600, clogging of a filter assembly, such as filter assembly 210 (FIG. 3), may be reduced or prevented as discussed in greater detail below.

As may be seen in FIG. 7, at step 610, wash fluid, such as a mixture of water, detergent, etc., is directing into tub 104. As an example, tub 104 may be filled with wash fluid at step 610 until sump assembly 170 of tub 104 is filled with wash fluid. In particular, controller 137 may actuate a valve (not shown) coupled to spout 160 in order to direct wash fluid into tub 104 and fill tub 104 at step 610.

At step 615, a wash cycle of dishwasher appliance 100 is initiated. Turing back to FIG. 3, a flow of wash fluid is drawn from filtered volume 220 of sump 200 to spray assembly 250 during the wash cycle at step 615. For example, controller 137 may operate second pump 242 in order to draw the flow of wash fluid from filtered volume 220 of sump 200 to spray assembly 250 at step 615. In addition, a flow of wash fluid is directed from unfiltered volume 214 of sump 200 to wash compartment 106 of tub 104 during the wash cycle at step 615. For example, controller 137 may operate first pump 240 in order to direct the flow of wash fluid from unfiltered volume 214 of sump 200 to wash compartment 106 of tub 104 at step 615. Thus, valve 260 is in the first configuration during the wash cycle at step 615.

As may be seen in FIG. 3, the flow of wash fluid from filtered volume 220 of sump 200 to spray assembly 250 may be drawn, e.g., by second pump 242, at the same time as the flow of wash fluid is directed from unfiltered volume 214 of sump 200 to wash compartment 106 of tub 104, e.g., by first pump 240, during the wash cycle. In such a manner, the cross-flow across filter media 212 can be generated, and clogging of filter media 212 can be limited or reduced by such cross-flow during the wash cycle. To assist the cross-flow with limiting or reducing clogging of filter media 212, a velocity of wash fluid within filtered volume 220 of sump 200 during step 615 may be less than a velocity of wash fluid within unfiltered volume 214 of sump 200 during step 615.

Wash fluid exiting spray assembly 250 during the wash cycle also assists with removing particles P from articles within wash compartment 106 of tub 104 during the wash cycle at step 620. The wash cycle may have any suitable duration. For example, the wash cycle may be between about two minutes and about forty minutes. Thus, at step 625, the wash cycle is continued and particles P are removed from articles in wash compartment 106 until a wash cycle time interval elapses.

Particles P can accumulate within or in sump 200 and/or filter assembly 210 over time during the wash cycle. Thus, method 600 includes steps for collecting particles P within filter assembly 210, e.g., after the wash cycle is complete. In particular, a particle or soil collection cycle of dishwasher appliance 100 is started at step 630. Turing now to FIG. 4, a flow of wash fluid is drawn from filtered volume 220 of sump 200 to spray assembly 250 during the soil collection cycle at step 630. For example, controller 137 may operate second pump 242 in order to draw the flow of wash fluid from filtered volume 220 of sump 200 to spray assembly 250 at step 630. In addition, first pump 240 is deactivated during the soil collection cycle at step 630. Valve 260 may be in either of the first or second configurations during the soil collection cycle at step 630.

As may be seen in FIG. 4, the flow of wash fluid from filtered volume 220 of sump 200 to spray assembly 250 may be drawn, e.g., by second pump 242, while first pump 240 is deactivated during the soil collection cycle. Thus, the cross-flow across filter media 212 described above may not be generated during the soil collection cycle, and filter assembly 210 may act as a dead-end filtration system. In such a manner, particles P accumulate on filter media 212 of filter assembly 210, e.g., due to the lack of cross-flow within filter assembly 210, during the soil collecting cycle at step 635. The soil collection cycle may have any suitable duration. For example, the soil collection cycle may be between about two seconds and about ten seconds. As another example, the duration of the soil collection cycle may be selected such that second pump 242 does not starve during the soil collection cycle. Thus, at step 640, the soil collection cycle is continued and particles P are collected in filter assembly 210 until a soil collection cycle time interval elapses.

As discussed above, particles P collect within filter assembly 210 during the soil collection cycle. To hinder or prevent such particles P from affecting operation of dishwasher appliance 100, method 600 includes steps for flushing particles P from filter assembly 210, e.g., after the soil collection cycle is complete. In particular, a drain cycle of dishwasher appliance 100 is commenced at step 645. Turing now to FIG. 5, a flow of wash fluid is directed from unfiltered volume 214 of sump 200 to drain 262 during the drain cycle at step 645. For example, controller 137 may operate first pump 240 in order to direct the flow of wash fluid from unfiltered volume 214 of sump 200 to drain 262 at step 645. Thus, valve 260 is in the second configuration during the drain cycle at step 645. In addition, second pump 242 is deactivated during the drain cycle at step 645.

As may be seen in FIG. 5, the flow of wash fluid from unfiltered volume 214 of sump 200 to drain 262 may be drawn, e.g., by first pump 240, while second pump 242 is deactivated during the drain cycle. Thus, wash fluid within unfiltered volume 214 of sump 200 is not urged through filter media 212 towards filtered volume 220 of sump 200. In particular, particles P on filter media 212 of filter assembly 210 may be flushed from filter media 212, e.g., due to a flow of wash fluid from filtered volume 220 to unfiltered volume 214 through filter media 212, and particles P are also directed out of filter assembly 210 to drain 262, e.g., due to operation of first pump 240, during the drain cycle at step 650. The drain cycle may have any suitable duration. For example, the drain cycle may be between about one minute and about two minutes. Thus, the drain cycle is continued and particles P are flushed from filter assembly 210 until a drain cycle time interval elapses at step 655.

It should be understood that steps 610-655 may be repeated as need during operation of dishwasher appliance 100. Thus, the wash cycle, the soil collection cycle and the drain cycle may be repeated as necessary to properly clean articles within dishwasher appliance 100. At step 660, any remaining wash fluid within tub 104 may be removed, e.g., when articles within dishwasher appliance 100 are suitably clean.

As may be seen in FIG. 6, method 600 may also include an overlap or transition cycle between the soil collection cycle and the drain cycle. During the transition cycle, first and second pumps 240 and 242 are activated and operated. In addition, valve 260 is in the second configuration. The transition cycle may assist with flushing particles P from filter assembly 210 to drain 262, e.g., prior to the drain cycle. The transition cycle may have any suitable duration. For example, the transition cycle may be about two seconds.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dishwasher appliance having a tub with a sump positioned at a bottom portion of the tub, a filter medium within the sump positioned between a filtered volume of the sump and an unfiltered volume of the sump, a spray assembly also positioned within a wash chamber of the tub, the method comprising:

operating a first pump and a second pump of the dishwasher appliance during a wash cycle of the dishwasher appliance, the first pump urging wash fluid from the unfiltered volume of the sump to the wash chamber of the tub during said step of operating, the second pump urging wash fluid from the filtered volume of the sump to the spray assembly during said step of operating;

working the second pump of the dishwasher appliance during a soil collection cycle of the dishwasher appliance such that the second pump urges wash fluid from the filtered volume of the sump to the spray assembly, the first pump of the dishwasher appliance being deactivated during said step of working; and running the first pump of the dishwasher appliance during a drain cycle of the dishwasher appliance such that the first pump urges wash fluid out of the sump, the second pump of the dishwasher appliance being deactivated during said step of running.

2. The method of claim 1, further comprising adjusting a valve of the dishwasher appliance to a cross-flow configuration for said steps of operating and working, the valve coupled to an exit conduit extending from the unfiltered volume of the sump, the valve directing wash fluid in the exit conduit to the sump in the cross-flow configuration.

3. The method of claim 1, wherein said step of operating is performed before said steps of working and running and said step of working is performed before said step of running.

4. The method of claim 1, wherein said steps of operating, working and running are performed consecutively during operation of the dishwasher appliance.

5. The method of claim 1, wherein a duration of the soil collection cycle is less than about fifteen seconds and greater than about two seconds.

6. The method of claim 1, wherein a duration of the drain cycle is less than about two minutes and greater than thirty seconds.

7. The method of claim 1, further comprising filling a tub of the dishwasher appliance with wash fluid prior to said step of operating.

8. The method of claim 1, wherein a velocity of wash fluid in the filtered volume of the sump is less than a velocity of wash fluid in the unfiltered volume of the sump during said step of operating.

9. The method of claim 2, further comprising actuating the valve of the dishwasher appliance to a drain configuration for said step of running, the valve directing wash fluid in the exit conduit to a drain in the drain configuration.

10. A method for operating a dishwasher appliance having a tub with a sump positioned at a bottom portion of the tub, a filter medium within the sump positioned between a filtered volume of the sump and an unfiltered volume of the sump, a spray assembly also positioned within a wash chamber of the tub, the method comprising:

initiating a wash cycle of the dishwasher appliance;

operating a first pump and a second pump of the dishwasher appliance during the wash cycle of the dishwasher appliance, the first pump urging wash fluid from the unfiltered volume of the sump to the wash chamber of the tub during said step of operating, the second pump urging wash fluid from the filtered volume of the sump to the spray assembly during said step of operating;

starting a soil collection cycle of the dishwasher appliance after the wash cycle of the dishwasher appliance;

working the second pump of the dishwasher appliance during the soil collection cycle of the dishwasher appliance such that the second pump urges wash fluid from the filtered volume of the sump to the spray assembly, the first pump of the dishwasher appliance being deactivated during said step of working;

commencing a drain cycle of the dishwasher appliance after the soil collection cycle of the dishwasher appliance; and running the first pump of the dishwasher appliance during the drain cycle of the dishwasher appliance such that the first pump urges wash fluid out of the sump, the second pump of the dishwasher appliance being deactivated during said step of running.

11. The method of claim 10, further comprising adjusting a valve of the dishwasher appliance to a cross-flow configuration for the wash cycle and the soil collection cycle of the dishwasher appliance, the valve coupled to an exit conduit extending from the unfiltered volume of the sump, the valve directing wash fluid in the exit conduit to the sump in the cross-flow configuration.

12. The method of claim 10, wherein a velocity of wash fluid in the filtered volume of the sump is less than a velocity of wash fluid in the unfiltered volume of the sump during said step of operating.

13. The method of claim 11, further comprising actuating the valve of the dishwasher appliance to a drain configuration for the drain cycle of the dishwasher appliance, the valve directing wash fluid in the exit conduit to a drain in the drain configuration.

* * * * *